US006538565B1

(12) United States Patent
Gotfried

(10) Patent No.: US 6,538,565 B1
(45) Date of Patent: Mar. 25, 2003

(54) APPLAUSE DEVICE

(76) Inventor: Bradley L. Gotfried, 949 SE. Bridge Rd., Hobe Sound, FL (US) 33455

( * ) Notice: Subject to any disclaimer, the term of this patent is extended or adjusted under 35 U.S.C. 154(b) by 0 days.

(21) Appl. No.: 09/619,008

(22) Filed: Jul. 19, 2000

(51) Int. Cl.[7] ..... G08B 3/10

(52) U.S. Cl. ..... 340/384.3; 340/384.1; 340/384.4; 340/384.7; 340/691.1; 340/691.2; 340/692

(58) Field of Search ..... 340/384.3, 384.1, 340/384.4, 384.7, 691.1, 691.2, 692, 574; 362/103, 105, 311

(56) References Cited

U.S. PATENT DOCUMENTS

| | | | | | |
|---|---|---|---|---|---|
| 4,397,210 | A | * | 8/1983 | Finch | 84/1.03 |
| 4,486,975 | A | * | 12/1984 | Harreld et al. | 446/220 |
| 4,556,932 | A | * | 12/1985 | Lehrer et al. | 362/103 |
| 4,992,704 | A | * | 2/1991 | Stison | 315/312 |
| 5,064,195 | A | | 11/1991 | McMahan et al. | 275/374 |
| 5,137,488 | A | | 8/1992 | Yeh | 446/397 |
| 5,259,807 | A | | 11/1993 | Crow | 446/473 |
| D371,785 | S | | 7/1996 | DiCampli et al. | D14/163 |
| 5,674,076 | A | | 10/1997 | Billings et al. | 434/365 |
| 5,847,652 | A | * | 12/1998 | Yamamoto | 340/574 |
| 5,859,915 | A | | 1/1999 | Norris | 381/75 |
| 5,881,384 | A | | 3/1999 | Williams | 2/158 |
| 5,973,250 | A | * | 10/1999 | Zirille et al. | 84/600 |
| 6,007,211 | A | * | 12/1999 | Cheung | 362/103 |
| 6,020,823 | A | * | 2/2000 | DeCicco | 340/691.2 |
| 6,137,410 | A | * | 10/2000 | Sepulveda | 340/568.7 |
| 6,161,266 | A | * | 12/2000 | Anscher | 24/625 |

* cited by examiner

*Primary Examiner*—Daniel J. Wu
*Assistant Examiner*—Hung Nguyen
(74) *Attorney, Agent, or Firm*—Akerman Senterfitt

(57) ABSTRACT

An applause device includes a sound generator capable of generating at least one applause sound. The sound generator preferably can generate at least one sound which can indicate approval or disapproval, such as clapping, hollering, whistling, booing, and hissing. A switch permits the user to select between each of the sounds. The device also preferably comprises illumination structure so as to illuminate at least a portion of the sound generation device. In a preferred embodiment, the applause device is shaped substantially, at least in part, in the shape of an open hand. A method for generating applause sounds is also disclosed.

18 Claims, 2 Drawing Sheets

APPLAUSE DEVICE

CROSS-REFERENCE TO RELATED APPLICATIONS (Not Applicable)

FIELD OF THE INVENTION

This invention relates generally to portable sound generating devices, and more particularly to such devices that are used at sporting events, concerts, and other entertainment events.

BACKGROUND OF THE INVENTION

Sporting events, concerts and other entertainment events create the desire on the part of the audience to express approval or disapproval with the entertainment. In many cases, it is difficult to maintain a vocal presence without straining one's voice. Many attendees wish to also make a visual statement and, accordingly, wear hats and bring signs or other paraphernalia to hold up and waive so as to make a visual statement. Various noisemakers and compressed air sounding machines have previously been provided for attendees to make various sounds to signify their support, approval or disapproval. These devices do not permit the user to make a visual statement in a darkened stadium or auditorium. Also, the noisemakers generally produce sounds which are loud, but do not have any particular significance to the event.

SUMMARY OF THE INVENTION

An applause device, according to the invention, includes a housing and an applause sound generating device in the housing. The applause sound can be any suitable applause sound, and can be selected from sounds such as clapping, hollering, and whistling. The invention is not limited in that regard, however, as any sound which expresses approval or disapproval is acceptable. The applause device also preferably includes lighting structure. The lighting structure for lighting the applause device permits a visual statement in a darkened environment. In a preferred embodiment, the applause device is fashioned substantially in the shape of an open hand, so as to suggest applause.

Preferably, at least a portion of the housing comprises a light-emitting portion. The applause device preferably has a light source in the housing and a switch on the housing, wherein the switch activates the light source. As a result, the light-emitting portion is illuminated. The light-emitting portion can be translucent and/or transparent and, in a particularly preferred embodiment is formed at least partially of translucent plastic.

The applause device can have a switch on the housing, wherein the switch activates the applause sound generating device. The housing can have one or more apertures, so that at least a portion of the applause sound generated by the applause sound generating device can escape from the housing through the apertures.

The applause device can also include attachment structure attached to the housing. The attachment structure can be at least one of the group consisting of a hook, a ring, or a first synthetic material which detachably connects to a second synthetic material when the first and second materials are pressed together.

In an alternative embodiment of the invention, the applause device can include a housing having a light-emitting portion formed from material which is translucent and/or transparent, an applause sound generating device in the housing, a sound switch on the housing which activates the applause sound generating device, a light source in the housing, and an illuminating switch on the housing. The illuminating switch can activate the light source, whereby the light-emitting portion is illuminated.

A method for applauding, according to the invention, includes providing a device having an applause sound generating device, and operating the applause sound generating device to generate a sound of applause. The applause sound can be clapping, hollering, and/or whistling, although the invention is not limited in that regard, as any sound which expresses approval or disapproval is acceptable.

The method can also include a step of illuminating the applause device. The illuminating step can include providing a housing, wherein at least a portion of the housing comprises a light-emitting portion. The illuminating step can also include providing a light source in the housing and a switch on the housing, wherein the switch activates the light source, and configuring the switch to activate the light source. The light-emitting portion can be translucent and/or transparent and, in a particularly preferred embodiment is formed at least partially of translucent plastic.

The method can include providing a housing at least partially in the shape of an open hand. A switch can be provided on the housing, wherein the switch activates the applause sound generating device, causing the switch to activate the applause sound generating device. The method can also include providing at least one aperture in the housing, wherein at least a portion of the applause sound generated by the applause sound generating device escapes from the housing through the apertures.

The method can include attaching attachment structure to the housing. The attachment structure can be at least one of the group consisting of a hook, a ring, or a first synthetic material which detachably connects to a second synthetic material when the first and second materials are pressed together.

BRIEF DESCRIPTION OF THE DRAWINGS

There are shown in the drawings some embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
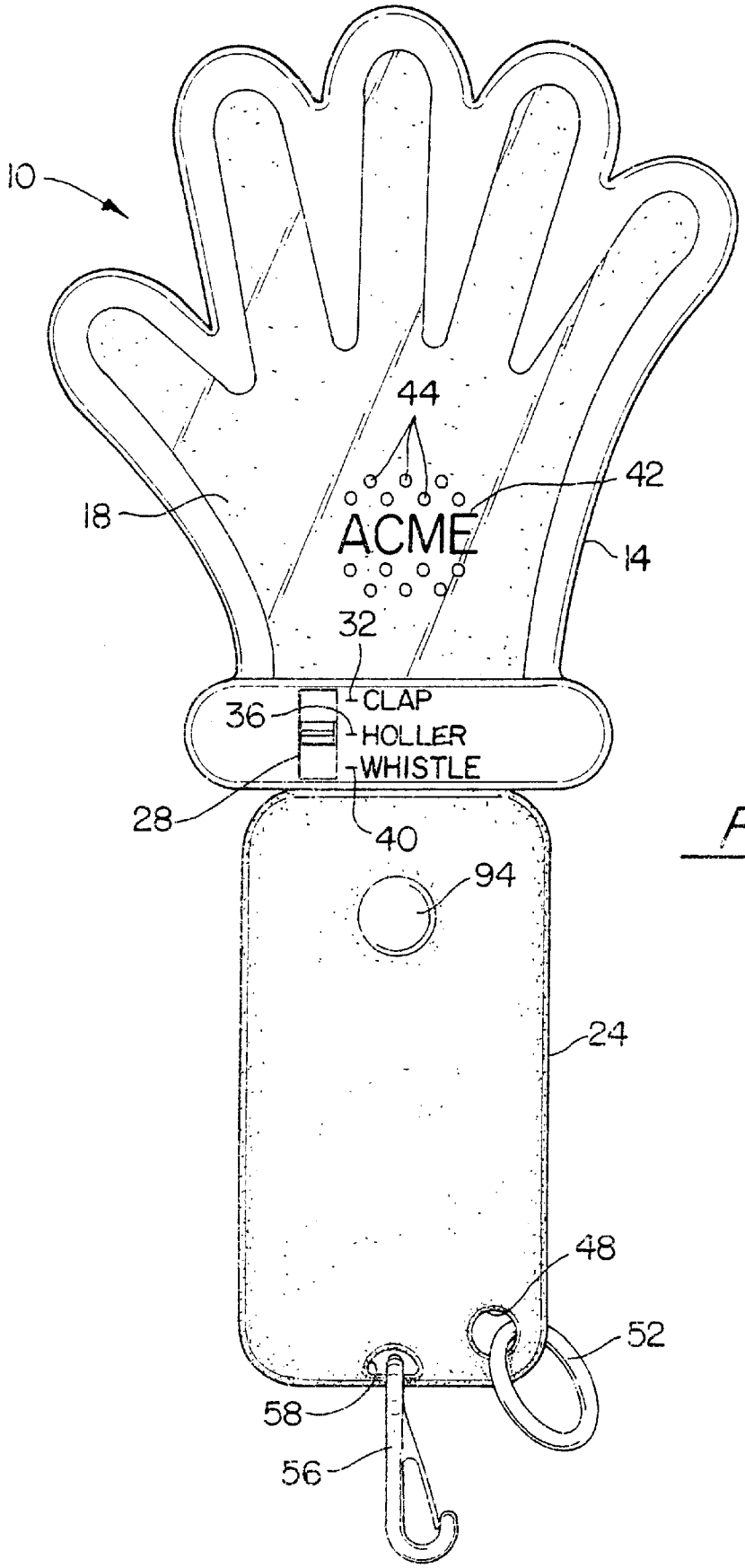
FIG. 1 is a plan view of an applause device according to the invention.
Figure 2:
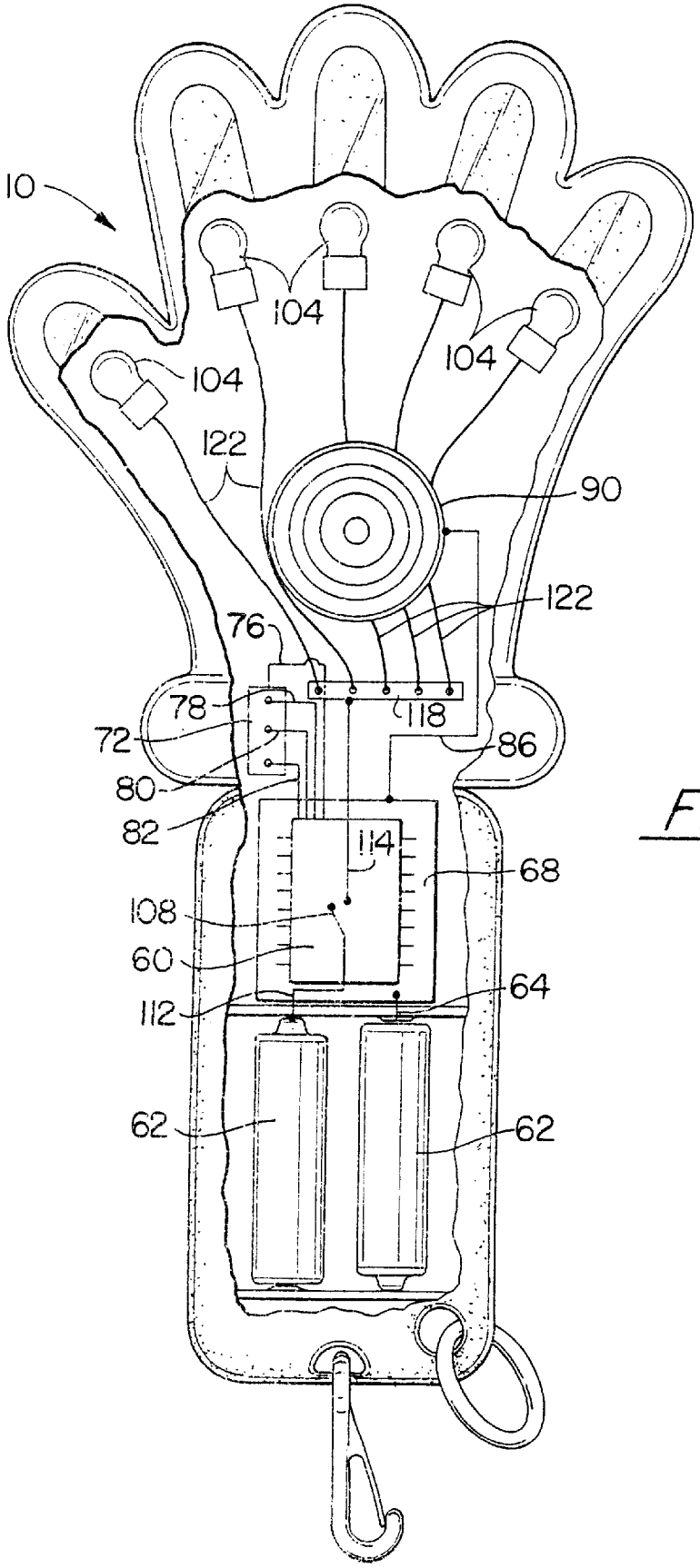
FIG. 2 is a plan view partially broken away to reveal interior features.

An applause device 10, according to the invention, is shown in FIGS. 1–2. The applause device 10 can have a housing 14 with an open interior. At least a portion of the housing 14 preferably comprises a light-emitting portion 18.

At least a portion of the housing 14 and/or the light-emitting portion 18 can have any identifiable shape, such as a shape which can be associated with a particular event, place, individual, logo, or team. In a particularly preferably embodiment, at least a portion of the housing 14 and/or the light-emitting portion 18 are shaped to suggest a human hand. This suggestion facilitates the communication of applause on behalf of the user.

The housing 14 can also have a handle section 24 with which the user can grasp the applause device 10. A switch 28 can be provided with which to generate the applause sounds. The switch 28 can be located on any portion of the applause device 10, and is preferably located on the handle section 24. As shown in FIG. 1, the switch 28 can have a number of different positions so as to permit the user to select among different applause sounds. In the embodiment shown, a switch position 32 is used to generate a clapping sound, a switch position 36 is used to generate a holler sound, and a switch position 40 is used to generate a whistle sound. More or fewer sounds, or other applause sounds, are alternatively possible. In this regard, it is understood that any sound which indicates approval or disapproval is acceptable. Examples of sounds which can suggest disapproval include booing and hissing.

The switch 28 can be of any suitable design, and in the embodiment shown the switch 28 is a slide switch which moves between the switch positions 32, 36, and 40 so as to permit the user to make a desired selection. In FIG. 1, the switch 28 is shown in switch position 36, which is used to generate a holler sound.

In a preferred embodiment, written indicia 42 can be incorporated into an outer surface of the housing 14. The written indicia 42 can be any name, symbol, logo, or other identifying mark, such as those associated with a particular event, place, logo, or team. The housing 14 can also have an attachment slot 48, through which any suitable attachment structure can be disposed to attach the applause device 10 to another object. The attachment slot 48 can be located on any suitable portion of the applause to device 10, and is preferably located on the handle section 24. Any suitable attachment structure is acceptable, such as a ring 52. The ring 52 can be used as a keychain ring.

Alternatively, attachment structure can be attached to the applause device 10 without the use of an attachment slot 48. For example, the attachment structure can be adhesively or mechanically connected directly to any suitable portion of the housing 14. Examples of acceptable adhesive and mechanical structure include any type of glue, a screw, a bolt, or synthetic materials which detachably connect when pressed together, such as Velcro®. It is understood, however, that the invention is not limited to these examples. As shown in the preferred embodiment of FIG. 1, the attachment structure can be a hook 56 connected directly to a portion of the housing 14 with a screw 58.

A plurality of apertures 44 can be provided in the housing 14 so as to permit sound generated by the applause device 10 to more efficiently escape from the housing 14. Sound generating devices that can be preprogrammed with one or more sounds are well known in the art, and the applause device 10 can generate one or more sounds using any suitable sound generating device. For example, it is known to preprogram a sound generating circuit to produce the sound of a police siren or a machine gun.

Any suitable sound generating device is acceptable for use with the invention, such as sound generating device 60, shown in FIG. 2. The sound generating device 60 can receive power from one or more batteries 62, which are connected by a suitable connection 64 to the sound generating device 60. The sound generating device 60 can be mounted on a suitable platform 68, such as a printed circuit board, as is known in the art. The switch 28 is operable to make a connection between at least one power contact 72, which can receive power from the sound generating device 60 through line 76. Return lines 78, 80, and 82 can be used in connection with switch positions 32, 36, and 40, respectively. As is known in the art, the movement of the switch 28 will complete a circuit between the contact 72 and one of the return lines 78, 80, and 82 to indicate to the sound generating device 60 which sound has been selected. A line 86 leads from the sound generating device 60 to an audio transducer 90, such as a speaker, which helps generate the appropriate sound.

The housing 14 can be illuminated in any suitable manner. For example, in the preferred embodiment of FIGS. 1 and 2, a switch 94 is provided in the housing 14 so as to permit one or more lights to be turned on within the housing 14, thereby illuminating the light-emitting portion 18. In an alternative example, the light-emitting function can be activated by another switch position of the switch 28.

The housing 14 and/or light-emitting portion 18 is preferably shaped so as to suggest the shape of an open hand to provide a visual expression of approval, although the invention is not limited in that regard. For example, the housing 14 or light-emitting portion 18 can be shaped so as to suggest disapproval.

The switch 94 can be of any suitable design, and in the embodiment shown is a push button toggle switch. The housing 14 and/or light-emitting portion 18 is suitably fashioned by several methods, but preferably is transparent or translucent and has lights to emit light through the transparent or translucent portion. The lights can be any suitable lighting, including flourescent lighting, light-emitting diodes, or incandescent tow bulbs, all of which are known in the art. In the embodiment shown, a plurality of incandescent bulbs 104 is provided so as to more evenly emit light from the light-emitting portion 18. It is understood that lights can be located at any suitable portion of the device 10.

The bulbs 104 are powered by means of a switch 108 which is operated by the switch 94. Power is provided by any suitable means, such as a connection 112 extending from the batteries 62. Power can extend through a line 114 to a bus 118, wherein a plurality of lines 122 extend to the bulbs 104.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A portable sound generating device for expressing approval or disapproval of a sporting or entertainment performance, the device comprising:

a housing substantially in the shape of a hand;

the housing comprising a handle structure;

a sound generating device in the housing; and lighting structure in the housing:

wherein at least a portion of the housing is formed of at least one of translucent and transparent materials, so that the lighting structure can illuminate at least a portion of the housing; and wherein the sound generating device can generate at least one sound selected from the group consisting of approval sounds and disapproval sounds.

2. The device of claim 1, wherein said light-emitting portion is formed of translucent plastic.

3. The device of claim 1, further comprising a switch on said housing for operating said lighting structure.

4. The device of claim 1, further comprising a switch on said housing for operating said sound generating device.

5. The device of claim 1, wherein said housing includes at least one aperture allowing exit of said sound from said housing.

6. The device of claim 1, further comprising attachment structure attached to said housing.

7. The device of claim 6, wherein said attachment structure is at least one of the group consisting of a hook, a ring, or a hook and loop fastener.

8. A portable sound generating device for expressing approval or disapproval of a sporting or entertainment performance, the device comprising:

a housing;

the housing comprising a handle structure;

the housing further comprising a light emitting portion, and lighting structure to illuminate at least a portion of the housing;

a sound generating device in the housing;

wherein the sound generating device can generate at least two sounds; and a switch allowing a user to switch between said at least two sounds, wherein at least one of said sounds is selected from approval sounds and disapproval sounds.

9. The device of claim 8, further comprising a switch on said housing for operating said lighting structure.

10. The device of claim 8, wherein said housing includes at least one aperture allowing exit of said sound from said housing.

11. The device of claim 8, further comprising attachment structure attached to said housing.

12. The device of claim 11, wherein said attachment structure is at least one of the group consisting of a hook, a ring, or a hook and loop fastener.

13. A method of generating a sound for expressing approval or disapproval of a sporting or entertainment performance, comprising the steps of:

providing a housing substantially in the shape of a hand;

providing a sound generating device in the housing, wherein the sound generating device can generate at least one sound selected from the group consisting of approval sounds and disapproval sounds;

providing lighting structure in the housing, wherein at least a portion of the housing is formed of at least one of translucent and transparent materials, so that the lighting structure can illuminate at least a portion of the housing;

generating at least one sound with the sound generating device; and illuminating the housing.

14. The method of claim 13, further comprising a switch on said housing for operating said lighting structure, the method further comprising the step of operating the switch to illuminate the housing.

15. The method of claim 13, further comprising a switch on said housing for operating said sound generating device, the method further comprising the step of operating the switch to generate the at least one sound.

16. The method of claim 13, wherein the sound generating device can generate at least two different sounds, the method further comprising the steps of;

selecting between the at least two different sounds; and generating a selected sound.

17. A method of generating a sound for expressing approval or disapproval of a sporting or entertainment performance, comprising the steps of:

providing a housing comprising a light emitting portion;

providing lighting structure in the housing;

illuminating the housing;

providing a sound generating device in the housing, wherein the sound generating device can generate at least two sounds, at least one of said sounds selected from approval sounds and disapproval sounds;

providing a switch allowing a user to switch between said at least two sounds;

selecting at least one sound by operating the switch; and generating the selected sound.

18. The method of claim 17, further comprising a switch on the housing for operating the lighting structure, the method further comprising the step of operating the switch to illuminate the housing.

* * * * *